United States Patent [19]

Gorodissky et al.

[11] Patent Number: 4,960,406

[45] Date of Patent: Oct. 2, 1990

[54] CENTRIFUGE

[76] Inventors: Boris P. Gorodissky, Leninsky prospekt, 154, kv. 201.; Alexandr I. Sambursky, ulitsa 1, Susanina, 6, Korpus 4, kv. 10., both of Moscow, U.S.S.R.

[21] Appl. No.: 380,902

[22] Filed: Jul. 17, 1989

[30] Foreign Application Priority Data

Jul. 18, 1988 [SU] U.S.S.R. ..... 4447753

[51] Int. Cl.[5] ..... B04B 13/00

[52] U.S. Cl. ..... 494/9; 494/10

[58] Field of Search ..... 494/10, 1, 7, 8, 9, 494/11, 13, 84; 210/781, 782

[56] References Cited

U.S. PATENT DOCUMENTS 3,746,247 7/1973 Camilliere ..... 494/10
3,982,162 9/1976 Olliffe ..... 494/10
4,205,261 5/1980 Franklin ..... 494/10
4,601,696 7/1986 Kamm ..... 494/13
4,772,254 9/1988 Grassi ..... 494/10

FOREIGN PATENT DOCUMENTS 0139290 10/1984 European Pat. Off. .

*Primary Examiner*—Robert W. Jenkins
*Attorney, Agent, or Firm*—Lilling & Lilling

[57] ABSTRACT

A centrifuge includes a drive which revolves a rotor whose speed is controlled by a sensor located on a mounting plate which is immovably fixed in a recess of a ring installed on the mounting surface of the drive casing. The ring has a hole accommodating a movable element installed with a provision for touching over the radius of curvature upon said mounting surface of the drive casing and ensuring the movement of said ring relative to the lower surface of the rotor for installing the sensor at a certain distance from said surface at which the optimum sensitivity to the rotation speed of the rotor is ensured.

6 Claims, 4 Drawing Sheets

CENTRIFUGE

BACKGROUND OF THE INVENTION

1. Field of the Invention

The present invention relates to centrifuges and, more particularly, to the means for fastening the sensor for registering the rotation speed of the centrifuge rotor and can be utilized mostly for controlling the rotation speed of the centrifuge rotor that might be required in biotechnology, biophysics, biology and other fields.

2. Description of the Related Art

It is commonly known that the rotation speed of the centrifuge rotor shall not exceed a preset value since it may result in serious troubles including breakage of the rotor and a complete failure of the centrifuge.

It becomes particularly important because the rotors of modern centrifuges revolve at speeds reaching scores of thousands of rpm. Therefore, each design of the centrifuge incorporates a sensor whose function is to check the rotation speed and to cut off the power supply and, consequently, stop the rotor if its speed rises above the preset value.

As a rule, this problem is solved by the provision of a disc secured on the lower face of the rotor and having alternating marks differing, for example, in their colour. These marks are read off by an oppositely-installed sensor, for example an optical one.

Whatever the type of the sensor, it must have an optimum sensitivity to the rotation speed of the rotor which can be attained by changing the sensor's position. The design of the device for installing the sensor and adjusting its position shall be compact because the space for accommodating said sensor in any type of centrifuge is always limited by the distance between the drive and the rotor.

Besides, the design should be highly reliable both from the standpoint of fixing the sensor in the position selected by adjustments and from the standpoint of installing and removing it, for example during preventive maintenance.

Known in the prior art is a device (U.S. Pat. No. 3,693,023) which can serve for controlling the rotation speed of the centrifuge rotor. However, the design of this device prevents adjusting the position of the sensor with regard to its optimum sensitivity to the rotation speed of the rotor.

Besides, this design comprises a great number of elements and is, therefore, quite complicated. The use of this design proves to be impracticable in view of its complexity and insufficient reliability caused by the impossibility of optimization of the sensor sensitivity to the rotation speed of the rotor.

Also known in the art is a centrifuge (EP, A, No. 0139290) wherein there is a provision for changing the position of the sensor with respect to its optimum sensitivity to rotation speed of the centrifuge rotor. The sensor is located on a mounting plate accommodated in a recess of the ring installed on the mounting surface of the casing of the drive which revolves the centrifuge rotor.

The centrifuge comprises a rotor-revolving drive and the rotor speed is controlled by a sensor (photosensor) located on a mounting plate accommodated in a recess of the supporting ring installed on the mounting surface of the drive casing. The sensor is capable of moving relative to the lower surface of the rotor, to the position of maximum sensitivity to its rotation speed. Installed on the lower surface of the rotor is a special speed indicator. A photosensitive device registering the rotation speed of the rotor is installed on the mounting plate of the sensor, said plate being provided with a projection of a sufficient size for installing the photosensitive device on the mounting plate. The mounting plate of the photosensor is linked with the supporting ring by two adjusting elements located on the ends of the mounting plate. These adjusting elements displace the mounting plate complete with the photosensor relative to the supporting ring thus setting the photosensitive device at an optimum distance from the speed indicator located on the lower surface of the rotor.

However, the design of this device is complicated and comprises a large number of fasteners of both the ring and mounting plate. The main ring fastening element has various complicated cutouts and junctions. In view of the fact that the position of the sensor is adjusted by shifting the mounting plate with the aid of two adjusting elements (screws), even concurrent rotation of said screws fails to ensure strict vertical orienting of the sensor relative to the lower surface of the centrifuge rotor. This inevitably reduces the accuracy of measuring the rotor speed and, as a consequence, affects the reliability of the centrifuge. In addition, the very process of adjustment is highly labour-consuming and takes much time.

Another disadvantage of this centrifuge consists in that the photocell of the sensor is glued to the mounting plate. On the one hand, this denies the possibility of prompt replacement of the faulty photocell and, on the other, it reduces the reliability of the device. Thus, the known design is quite sophisticated, it hinders the process of adjustment and fails to ensure the requisite accuracy and reliability.

SUMMARY OF THE INVENTION

In view of the above, an object of the invention resides in providing a simple design of the adjustable device for installing the rotor speed sensor of the centrifuge.

Another object of the invention resides in providing means for simple and accurate adjustment of the sensor position relative to the lower surface of the centrifuge rotor.

Still another object of the invention resides in ensuring high reliability of fixing the sensor in the position selected during adjustments, and in reliable fastening of the sensor photocell.

These and other objects of the invention are achieved by providing a centrifuge comprising:

a drive;

a rotor rotated by said drive and provided with a marked disc on the lower surface;

a casing of said drive provided with a mounting surface;

a ring installed on said mounting surface of said casing of said drive and having a recess;

a mounting plate secured immovably in said recess of said ring;

a rotor speed sensor installed on said mounting plate with a provision for moving relative to said lower surface of said rotor to the position of optimum sensitivity to its rotation speed;

said ring installed on said mounting surface has a hole; and a movable element accommodated in said hole and installed with a provision for touching said mounting surface of said casing of said drive over its radius of curvature and ensuring the movement of said ring relative to said lower surface of said rotor for setting said sensor at a certain distance from said surface, thereby ensuring the optimum sensitivity to the rotation speed of the rotor.

These efforts have materialized in providing a simple design of the adjusting device for installing the sensor of rotation speed of the centrifuge rotor.

Preferably, the hole for accommodating the movable element should be oriented tangentially to the mounting surface of the drive casing. It is practicable that the movable element should have a recess whose shape is mutually complementary to the mounting surface of the drive casing.

It is expedient to provide the movable element with threads at one end, said thread carrying a nut which fixes the movable element. When the movable element is not fixed, the ring can move relative to the lower surface of the rotor to the position selected to ensure the optimum sensitivity of the sensor; when said movable element is fixed, the ring is kept in the selected position.

It is expedient that in case of a cylindrical shape of the mounting surface of the drive casing the curvature radius of the recess in the movable element should be made essentially equal to the radius of curvature of the cylindrical mounting surface.

As a result, it becomes possible to move the ring during sensor position adjustments not only vertically but also relative to the drive axis. As a result, the movable element ensures both adjusting the position of the sensor and its reliable fixing in the position of optimum sensitivity to the rotation speed of the rotor.

In the preferable embodiment of the centrifuge the sensor photocell is accommodated in the vertical recess of the mounting plate. The photocell can be secured in said recess by, for example, a resilient rod.

BRIEF DESCRIPTION OF THE DRAWINGS

Now the invention will be described in detail by way of example with reference to the drawings in which.

DETAILED DESCRIPTION OF THE PREFERRED EMBODIMENTS

Figure 1:
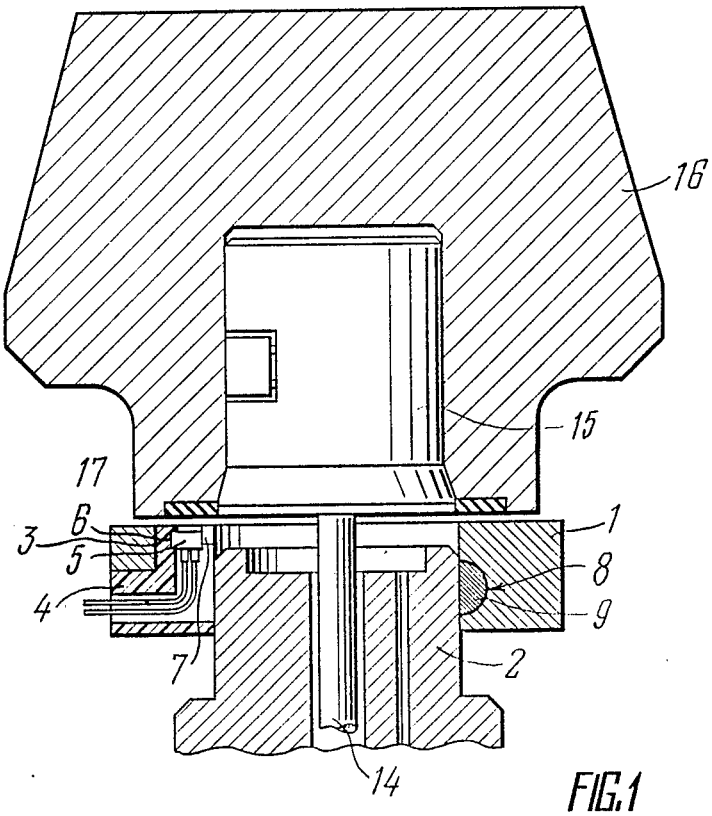
FIG. 1 is a vertical section of the centrifuge drive casing with the rotor and an adjustable device for installing the rotor speed sensor of the centrifuge according to the invention.

The centrifuge illustrated in FIG. 1 comprises a ring 1 installed on the mounting surface 2 of the centrifuge drive casing.

Accommodated in the recess 3 of the ring 1 is a mounting plate 4 with a sensor 5 which is secured in the vertical recess 6 of the mounting plate 4 with the aid of a resilient rod 7.

Figure 2:
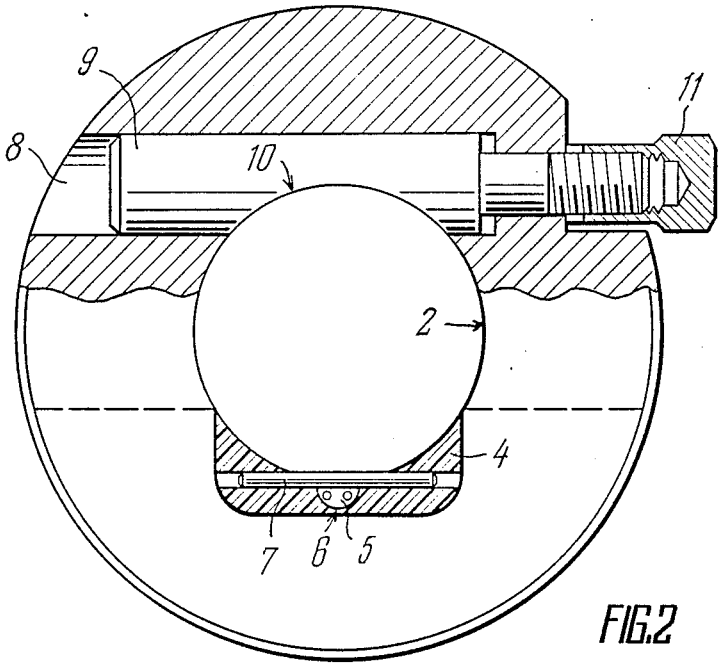
FIG. 2 is a top cross section of the casing, over the location of the hole with the movable element according to the invention.
Figure 3:
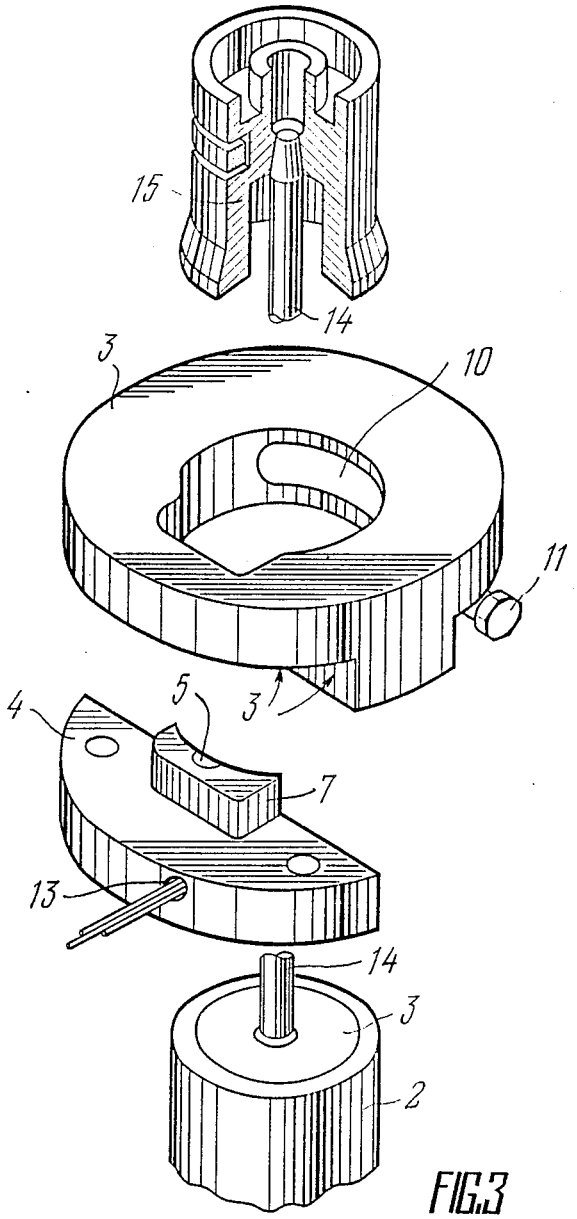
FIG. 3 is an exploded of the adapter, ring, mounting plate, sensor photocell and part of the drive casing, according to the invention.

The mounting plate 4 is secured immovably in the recess 3 of the ring 1 and said ring 1 has a hole 8 accommodating a movable element 9 installed (FIG. 2) with a provision for touching said mounting surface 2 of the drive casing over the curvature radius of said surface 2. The axis of the hole 8 is arranged tangentially to said surface 2 of the drive casing and the movable element 9 (screw) has a recess 10 whose shape is mutually complementary to said surface 2. In case of a cylindrical shape of said surface 2 as shown in FIG. 2 the curvature radius of the recess 10 of said element 9 is essentially equal to the curvature radius of the cylindrical mounting surface 2. In the particular embodiment of the movable element 9 one of its ends is provided with threads carrying a nut 11 which fixes the movable element 9. When the element 9 is not fixed, the ring 1 is capable of moving freely along the mounting surface 2 of the drive casing. When the movable element 9 is fixed with nut 11, the ring 1 is held in the selected position ensuring the optimum sensitivity of the sensor 5.

Figure 5:
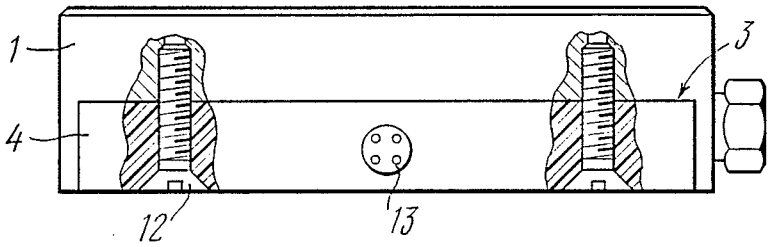
FIG. 5 shows the fastening of the mounting plate in the ring, a hole for letting out the wires of the sensor photocell and the nut of the movable element according to the invention.

The mounting plate 4 (FIG. 5) is immovably fixed in the recess 3 of the ring 1 by means of screws 12 and has a hole 13 for letting out the wires of the photocell of the sensor 5 (FIG. 1).

A resilient shaft 14 passing through the drive casing carries an adapter 15 provided for installing the centrifuge rotor 16.

Figure 4:
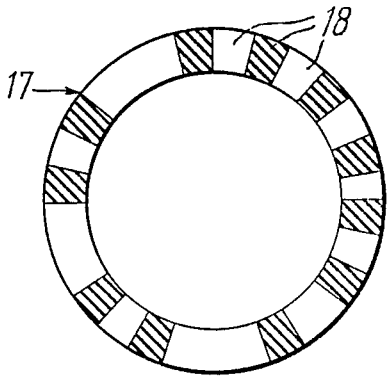
FIG. 4 is the marked disc installed on the lower surface of the centrifuge rotor according to the invention.

The disc 17 fastened to the lower surface of the rotor 16 has marks 18 (FIG. 4) and is installed in such a way that during rotation of the rotor 16 (FIG. 1) said marks would cross the sensitivity zone of the photocell of the sensor 5.

Besides, the movement of the ring 1 allows the sensor 5 to be set at a certain distance from the lower surface of the rotor, said distance ensuring optimum sensitivity to the rotation speed of the rotor 16.

Let us consider the functioning of the centrifuge.

Figure 6A:
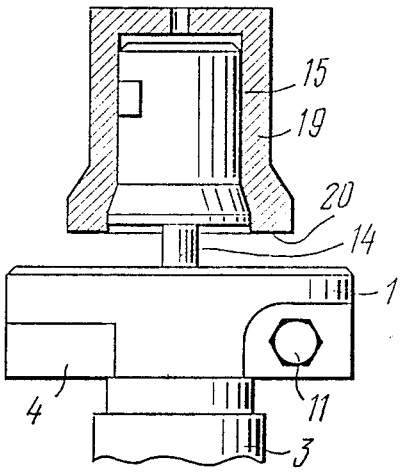
FIGS. 6 (*a, b, c*) shows the stages of adjusting the device.
Figure 6B:
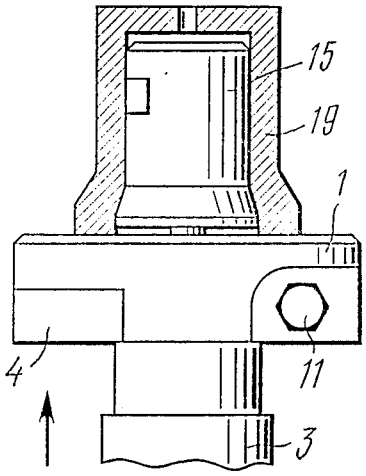
Figure 6C:
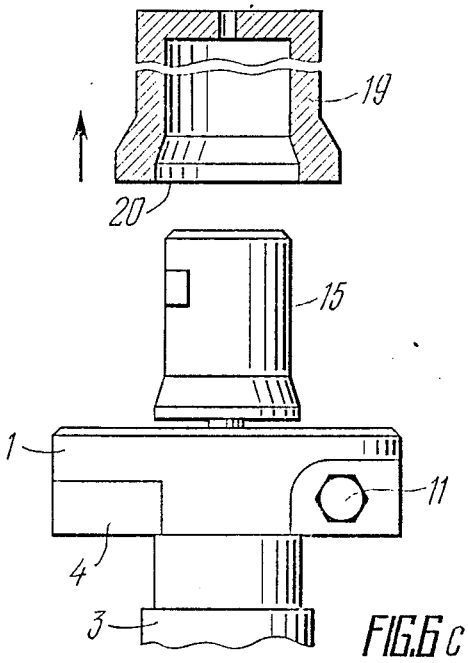

Before installing the rotor 16, a gauge 19 (FIG. 6*a*) with the same mounting hole as that of the rotor 16 is installed on the adapter 15. However, the depth of said hole in the gauge 19 is larger by the working clearance between the disc 17 (FIG. 1) and the ring 1. Then the ring 1 is moved all the way to bear against the lower face 20 of the gauge 19. This is the position of optimum sensitivity of the sensor 5. The ring 1 is fixed in this position by tightening the nut 11 thus completing the process of adjustment (FIG. 6*b*). Then the gauge 19 is removed from the adapter 15 (FIG. 6*c*) and the rotor 16 (FIG. 1) is installed instead. The drive (not shown) is started and the rotor starts rotating. The sensor 5, for example a photo-coupled pair, reads out the marks 18 (FIG. 4) from the disc 17 installed on the lower surface of the rotor 16 (FIG. 1) and shapes an electric signal, sending it to the control unit (not shown). As a result the rotation speed of the centrifuge rotor 16 is registered and controlled.

The control of rotor speed is characterized by a high accuracy due to the possibility of selecting the optimum location and guaranteed orientation of the photocell of sensor 5. Besides, a maximum operating convenience is ensured by the possibility of fixing and adjustment with the aid of a single movable element 9 and the possibility of replacing the sensor 5 by removing the resilient rod 7 from the mounting plate 4.

We claim:

1. A centrifuge comprising:

a drive having a casing with a mounting surface having a radius of curvature;

a centrifuge rotor rotated by said drive and having a lower surface and a marked disc on the lower surface;

a ring installed on said mounting surface of said casing of said drive and having a recess and a hole with an axis;

a mounting plate secured immovably in said recess of said ring;

a rotor speed sensor installed on said mounting plate and being movable relative to said lower surface of said rotor to a position of optimum sensitivity to its rotation speed;

a movable element accommodated in said hole and installed therein, said movable element touching said radius of curvature of said mounting surface of said casing of said drive and allowing movement of said ring relative to said lower surface of said rotor for setting said sensor at a certain distance from said surface for optimum sensitivity to the rotation speed of the rotor.

2. A centrifuge as claimed in claim 1 wherein the axis of said hole is arranged tangentially to said mounting surface of said drive and said movable element has a recess whose shape is mutually complementary to said mounting surface of said casing.

3. A centrifuge as claimed in claim 1 wherein said movable element is threaded at one end for carrying a nut which which fixes said movable element so that when said movable element is not fixed, said ring can move relative to said lower surface of said rotor to the selected position of optimum sensitivity of the sensor, and when said movable element is fixed, said ring is held in the selected position.

4. A centrifuge as claimed in claims 2 or 3 wherein in a case of a cylindrical shape of said mounting surface of said drive casing, said radius of curvature of said recess in said movable element is essentially equal to the radius of curvature of said cylindrical mounting surface.

5. A centrifuge as claimed in claim 1 wherein said immovably fixed mounting plate has a vertical recess for installing said sensor.

6. A centrifuge as claimed in claim 5 wherein said sensor is fixed in said recess by a resilient rod.

* * * * *